US005646596A

United States Patent [19]

Gumm

[11] Patent Number: 5,646,596

[45] Date of Patent: Jul. 8, 1997

[54] INTERACTIVE WINDOW DISPLAY

[75] Inventor: Darryl M. Gumm, Kohler, Wis.

[73] Assignee: IDC, Inc., Kohler, Wis.

[21] Appl. No.: 529,082

[22] Filed: Sep. 15, 1995

[51] Int. Cl.[6] ..... G08B 23/00

[52] U.S. Cl. ..... 340/573; 340/541; 340/508; 340/825.35; 340/600; 340/540; 40/627; 221/3; 250/221; 250/208.4; 250/397

[58] Field of Search ..... 340/540, 541, 340/552, 555, 556, 557, 568, 573, 825.35, 600; 40/427; 221/3, 6; 250/221, 208.4, 215, 397

[56] References Cited

U.S. PATENT DOCUMENTS

| | | | |
|---|---|---|---|
| 3,725,894 | 4/1973 | Geisler | 340/568 |
| 4,185,192 | 1/1980 | Wagner | 250/221 |
| 4,638,312 | 1/1987 | Quinn et al. | 340/286.13 |
| 4,670,798 | 6/1987 | Campbell et al. | 340/573 |
| 4,934,079 | 6/1990 | Hoshi | 40/427 |
| 5,097,981 | 3/1992 | Degasperi et al. | 369/30 |
| 5,117,407 | 5/1992 | Vogel | 221/3 |
| 5,264,822 | 11/1993 | Vogelman et al. | 340/692 |
| 5,477,219 | 12/1995 | Zarembo et al. | 340/571 |
| 5,485,139 | 1/1996 | Tarnovsky | 340/573 |

*Primary Examiner*—Jeffery Hofsass
*Assistant Examiner*—Benjamin C. Lee
*Attorney, Agent, or Firm*—Donald Cayen

[57] ABSTRACT

An interactive window display enables a person to activate one or more electrical devices located inside an enclosure from outside of the enclosure. Each electrical device is electrically connected to an infrared sensor located inside the enclosure. Each infrared sensor emits a light beam through a window of the enclosure. A person on the outside of the enclosure can manually place a small reflective card against the window in the path of the light beam of a selected infrared sensor. The light beam is reflected back to the infrared sensor. Upon sensing the reflected light beam, the infrared sensor produces a signal that energizes an electrical circuit and activates the associated electrical device.

10 Claims, 3 Drawing Sheets

INTERACTIVE WINDOW DISPLAY

BACKGROUND OF THE INVENTION

1. Field of the Invention

This invention pertains to remote controls, and more particularly to apparatus and methods for actuating electrical circuits at one location in response to human activities at a different location.

2. Description of the Prior Art

It is well known to control an electrical device located inside an enclosure from outside of the enclosure. Examples include electrically powered exhibits at museums or the like. Such exhibits are usually actuated by a person who manually pushes a button on the outside of a case that houses the exhibit. Another example, in which the enclosure is a house, is the ubiquitous doorbell. The foregoing, of course, are merely representative of a wide variety of remote control systems that utilize physical connections, e.g., buttons and wires, between the person and the activated device.

It is also well known to employ motion detectors to activate electrical devices in response to movements at locations remote from the devices. In a motion detector, there is no physical connection between a person who trips the detector and the activated electrical device. Rather, motion detectors invariably work on the principal of infrared light. A sensor unit emits a beam of infrared light, which is directed to a stationary reflector at some distance from the sensor. The reflector reflects the beam back to the sensor. The sensor is wired to control an electrical device such as a lamp or audio signal.

As long as the emitted beam is reflected back to the sensor, the electrical device remains in a deactivated state. However, if an opaque object, such as a part of a person's body, is placed between the infrared sensor and the reflector, the emitted beam is not received back at the sensor. In that case, the sensor operates to activate the electrical device. Common applications of light based motion detectors are burglar alarms and photoelectric eye door openers.

Despite the numerous types of remote control systems presently available, there nevertheless is room for new developments to them.

SUMMARY OF THE INVENTION

In accordance with the present invention, an interactive window display is provided that enables persons to activate an electrical device by completing an infrared light beam circuit. This is accomplished by apparatus that includes a manually manipulated reflector that is selectively placed in the path of the infrared light beam.

The infrared light beam is emitted by an infrared sensor. The light beam is directed to a space that is frequented by people. The infrared sensor is wired to a relay. The relay in turn is wired to control a power outlet. Any of numerous electrical devices, such as lamps and motors, can be connected to the power outlet.

The present invention is designed such that in normal situations the light beam from the infrared sensor vanishes into the relevant space. The usual activities of the people within the space have no effect on the infrared sensor. The infrared sensor and relay are wired such that, in that situation, no power is available at the power outlet. Consequently, the electrical devices connected to the power outlet are unactivated.

The present invention is further designed such that if the light beam emitted by the infrared sensor is reflected back to the sensor, the relay becomes controlled to provide power to the power outlet. In that situation, the electrical devices connected to the power outlet become activated.

It is a feature of the present invention that the light beam emitted by the infrared sensor is reflected back to the sensor by a deliberate and particular action by a person. Specially, the person manually places a portable reflector in the path of the light beam from the infrared sensor. Proper placement of the reflector causes the emitted beam to be reflected back to the sensor. When that occurs, the sensor controls the relay to provide power to the power outlet for activating the electrical devices. When the person removes the reflector from the path of the infrared beam, the sensor returns to its normal state and controls the relay to interrupt power to the power outlet. In that manner, the electrical devices are selectively activated and deactivated by placement and removal, respectively, of the reflector in the path of the infrared light beam.

The method and apparatus of the invention, using a portable reflector, thus enables a person to activate an electrical device from a location remote from the device. Activation occurs through careful manipulation of the reflector by the person without any physical connection between the person and the electrical device.

Other advantages, benefits, and features of the present invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
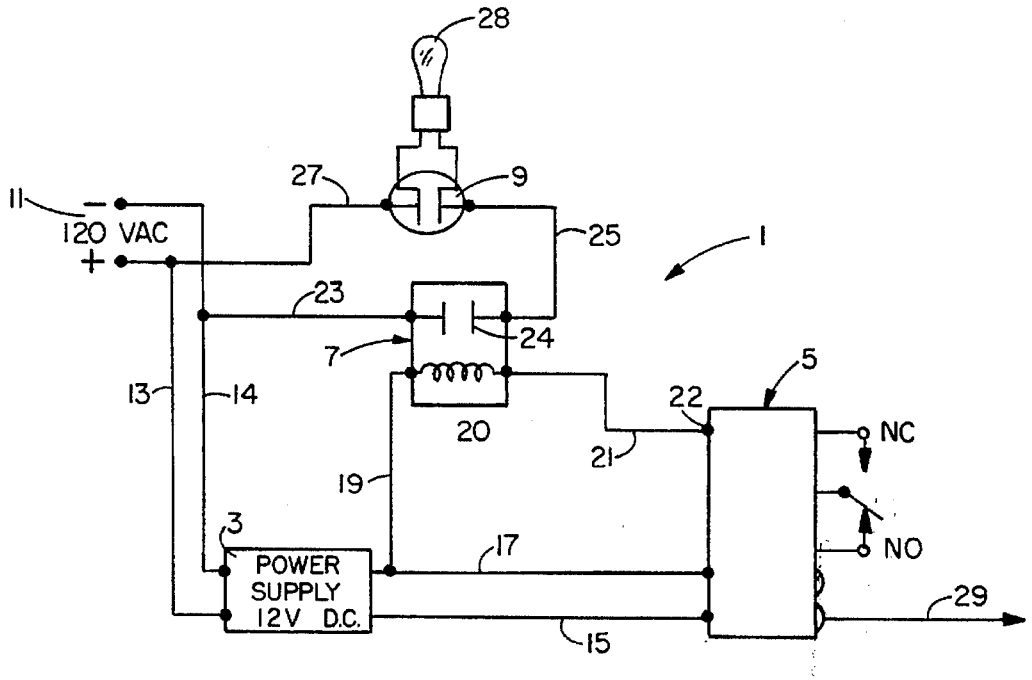
FIG. 1 is a wiring diagram of a typical electrical circuit showing the present invention in an unactuated state.

Referring to FIG. 1, the wiring diagram of an electrical circuit 1 is illustrated that shows the present invention in its simplest form. The electrical circuit 1 includes a power supply 3, infrared sensor 5, relay 7, and power outlet 9. The electrical circuit operates from 120 volts 60 cycle line power 11.

A satisfactory infrared sensor 5 is an infrared photoelectric sensor 1023 marketed by Radio Shack Division of Tandy Corporation, Fort Worth, Tex. In the illustrated construction, a wire 21 is connected to the normally closed terminal 22 of the infrared sensor. The wire 21 leads to the coil 20 of a relay 7.

I have found that a power supply 3 in the form of a 12 volt DC 500 milliamp transformer works very well. The power supply is wired to the line power 11 via wires 13 and 14. The positive outlet of the power supply is connected to the infrared sensor 5 by a wire 15; the negative output of the power supply is connected to the infrared sensor by a wire 17. Wire 19 taps off the negative wire 17 and is connected to the coil 20 of the relay 7.

A wire 23 leads from the normally open contacts 24 of the relay 7 to the line power 11. Another wire 25 leads from the relay contacts 24 to the power outlet 9. The power outlet is connected by a wire 27 to the line power. Any of a wide variety of 120 volt electrical devices, such as a lamp 28, is plugged into the power outlet.

With the electrical circuit 1 as described, energizing the power supply 3 causes the infrared sensor 5 to emit a beam 29 of infrared light into space. Ordinarily, the beam 29 is absorbed in space such that the normally closed contacts of the sensor are open. Consequently, no signal is present at the sensor terminal 22. The relay coil 20 thus remains de-energized, the contacts 24 remain open, there is no power at the outlet 9, and the lamp 28 remains unlit.

Figure 2:
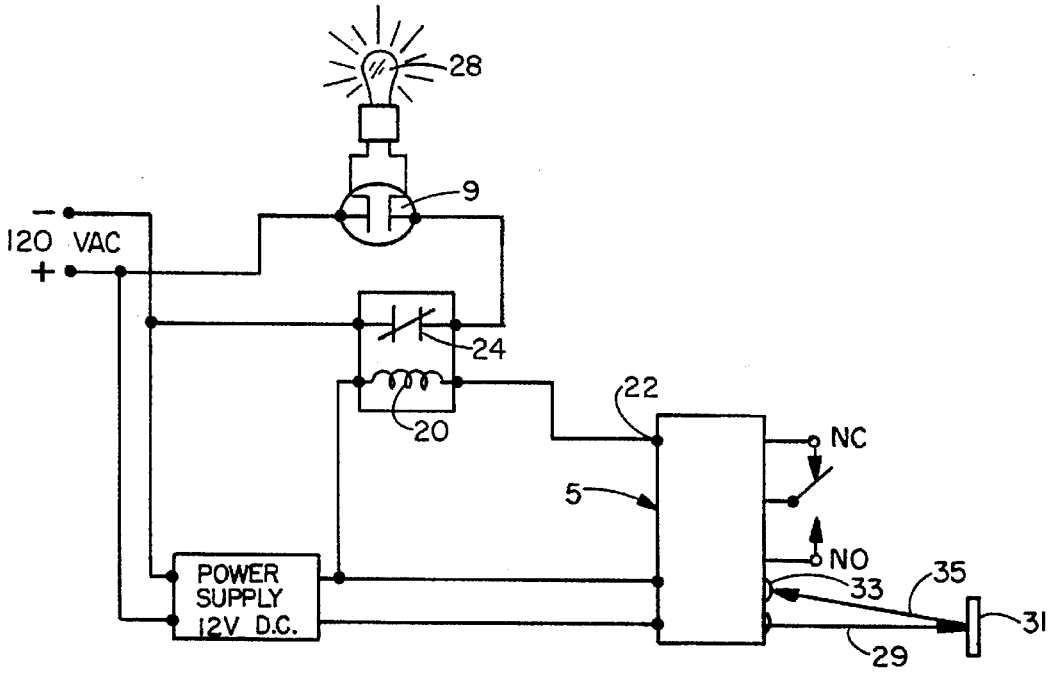
FIG. 2 is the wiring diagram of FIG. 1 showing the invention in an actuated state.

Now looking at FIG. 2, a reflector 31 is placed in the path of the infrared sensor light beam 29. By proper placement of the reflector 31, the beam 29 is made to reflect back along a path indicated by reference numeral 35 to a receiving port 33. Proper placement of the reflector is indicated by an indicator light on the sensor, not shown but well known in the art. When the reflected beam 35 is received back at the sensor port 33, the sensor normally closed contacts close to produce a signal at the terminal 22. As a result, the relay coil 20 is energized to close the contacts 24 and provide power to the outlet 9. The lamp 28 then lights.

If the reflector 31 is removed from the path of the infrared light beam 29, the sensor 5 acts to remove the signal at the terminal 22. The relay contacts 24 then open, and the lamp 28 becomes deactivated. The electrical circuit 1 thus returns to the state of FIG. 1.

Figure 3:
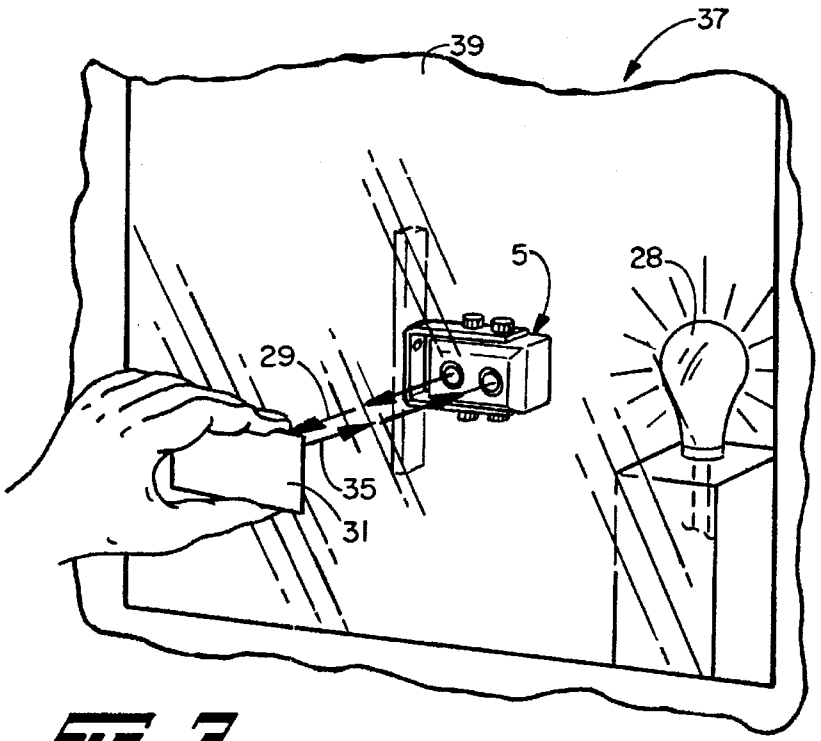
FIG. 3 is perspective view from outside of a typical interactive window display of the invention that uses the wiring diagrams of FIGS. 1 and 2.

It is a feature of the present invention that the reflector 31 is designed to be hand carried by a person for the specific purpose of intentionally actuating the circuit 1 and activating the electrical device 28. FIG. 3 shows a typical application of the circuit in the form of an interactive window display 37 actuated by a reflector 31. The interactive window display 37 can be any of numerous designs, but they all possess the common feature of a pane 39 of clear material, such as glass, interposed between the infrared sensor 5 and the reflector 31. Typically, the components of the electrical circuit are located inside an enclosure, which may be a room of a building. In that case, the pane 39 forms a window in the wall of the room. The sensor is located such that the beam 29 passes through the pane at a location that is easily accessible to a person standing outside the room.

In the usual situation of the interactive window display 37, the light beam 29 from the infrared sensor 5 passes through the pane 39 and into space, such as is illustrated in FIG. 1. The sensor does not function to energize the relay 7 or activate the electrical device 28. However, when a person places a reflector 31 in the proper location against the window pane, the reflected beam 35 is received back at the sensor port 33. That action causes the device 28 to be activated.

The versatility of the present invention is demonstrated by the fact the electrical device 28 need not be merely for amusement. Rather, the electrical device may be in the form of multiple lights that illuminate the interior of a building. Activating the inside lights at night by a watchman using a reflector 31 from outside the building provides a measure of security to the building.

It will be appreciated that the pane 39 need not be a window of a building. Rather, the pane may be a wall of a relatively small case located inside a building, such as a museum exhibit case pane. Properly placing the reflector 31 on the outside of the case pane causes the exhibit to actuate in the desired manner.

The reflectors 31 can be of almost any suitable size and material. However, it must have a flat highly reflective surface. I prefer a reflector made of heavy card stock approximately three inches long and one and one-half inches wide. The card stock is covered with a highly reflective material such as prism paper.

Figure 5:
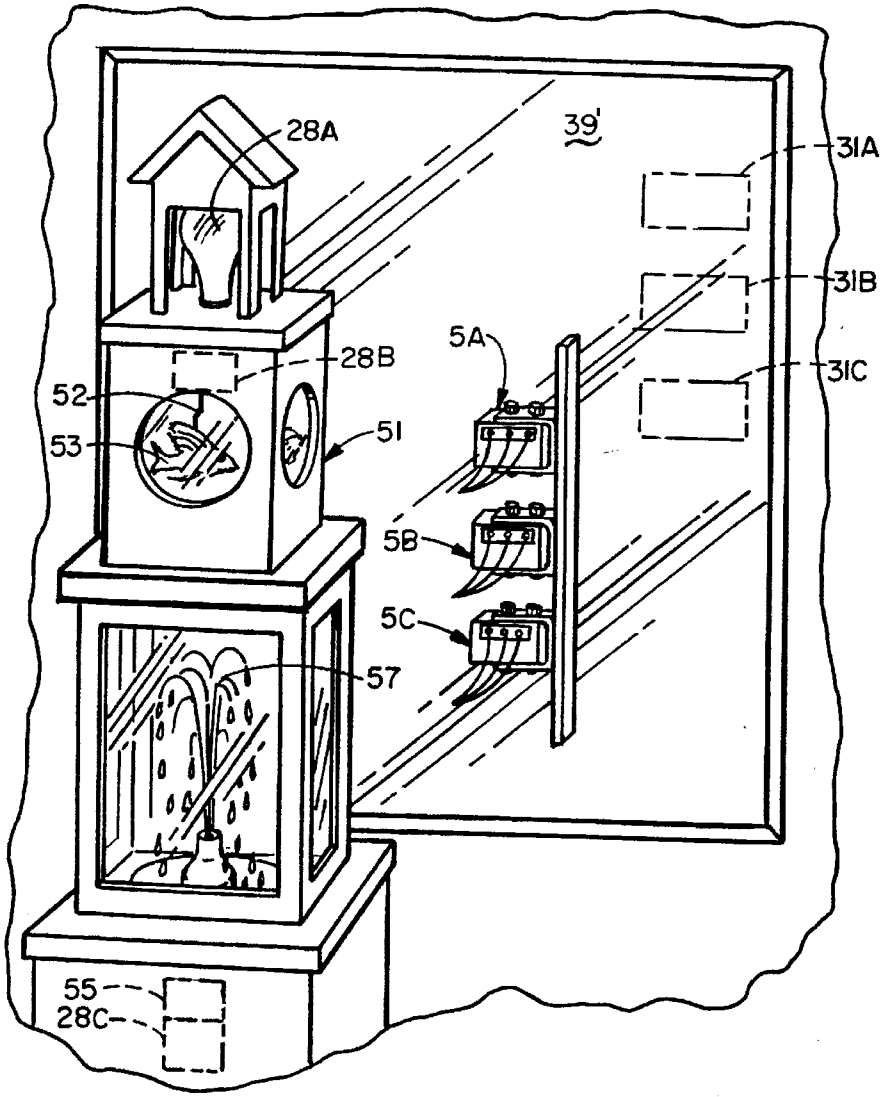
FIG. 5 is a perspective view from inside a typical alternate interactive window display that uses the wiring diagram of FIG. 4.
Figure 4:
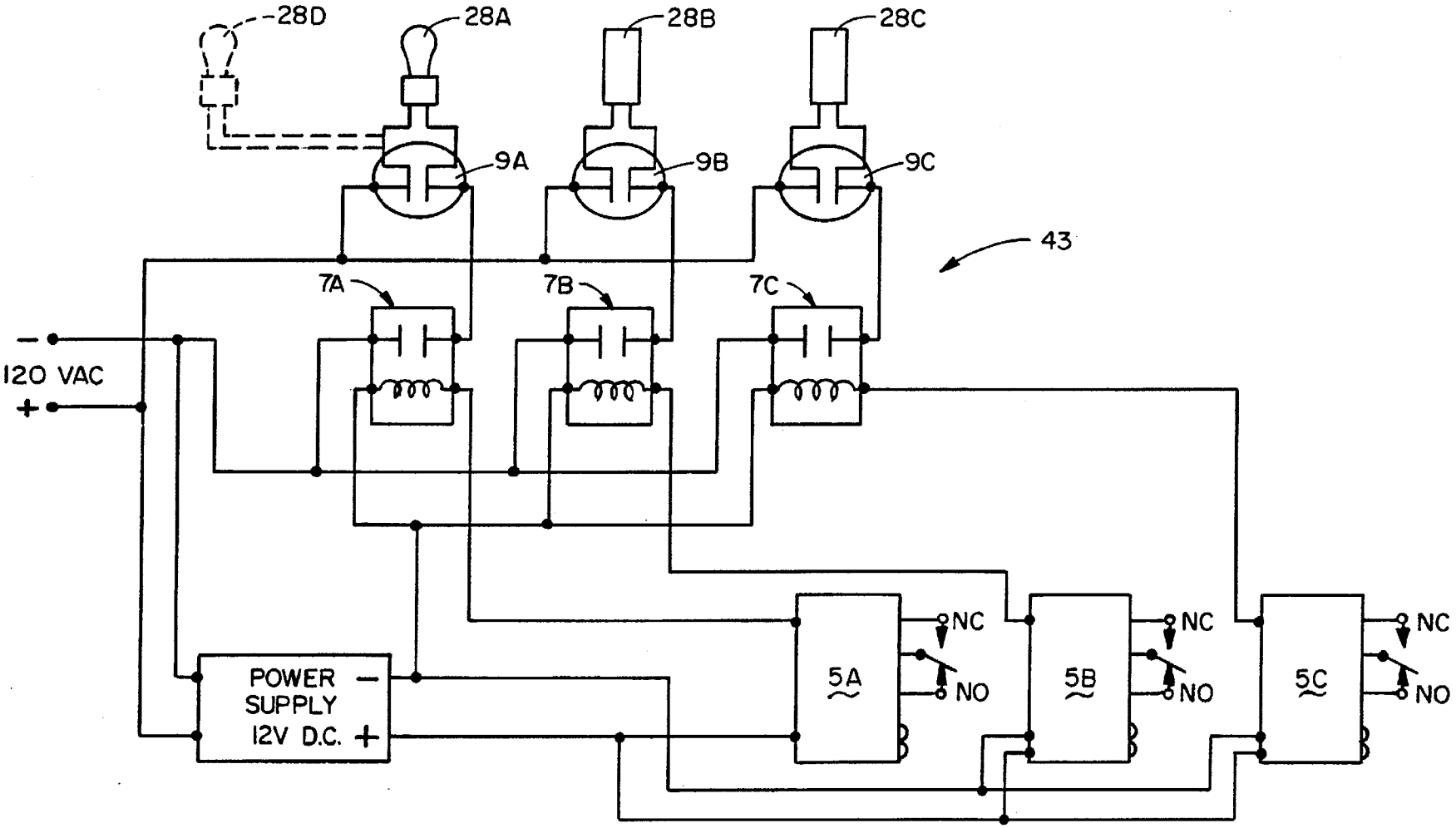
FIG. 4 is a typical wiring diagram according to the present invention that has multiple electrical devices.

Now turning to FIGS. 4 and 5, a typical alternate electrical circuit 43 has three infrared sensors 5A, 5B, 5C with associated relays 7A, 7B, 7C and power outlets 9A, 9B, and 9C. Electrical devices 28A, 28B, and 28C are connected to the respectively power outlets 9A, 9B, and 9C.

A representative interactive window display 49 has a miniature lighthouse 51. The electrical device 28A is a lamp at the top of the lighthouse 51. The electrical device 28B is a motor that is connected by a wire to an imitation fish 53. Activating the motor 28A causes the fish 53 to revolve in the inside of the lighthouse. The electrical device 28C is a motor that drives a pump to provide a water fountain 57 in the base of the lighthouse.

Activation of the electrical devices 28A, 28B, 28C is controlled by the associated infrared sensors 5A, 5B, and 5C, respectively. Any combination of the electrical devices is selectively activated by properly placing a reflector 31A, 31B, or 31C on the pane 39' of the interactive window display 49 to reflect the appropriate light beam back to the desired sensor.

It will be understood, of course, that more than one electrical device can be connected to a power outlet. For example, a lamp 28D can be connected to the power outlet 9A along with the lamp 28A. In that manner, more than one electrical device can be activate by a single infrared sensor, such as infrared sensor 5A.

In summary, the results and advantages of infrared sensors can now be more fully realized. The interactive window display provides sources of amusement, education, and security. This desirable result comes from using the combined functions of the infrared sensor 5 and the reflector 31. The infrared sensor emits a beam of infrared light into a space. Normally, the light beam is absorbed in the space without effect on the electrical circuit. However, intentional and proper placement of the reflector in the path of the light beam reflects the beam back to the sensor receiving port. In that situation, the electrical devices of the interactive window display that are controlled by the infrared sensor become activated. The interactive window display can be custom tailored to suit practically any purpose by having as many infrared sensors and electrical devices as desired.

It will also be recognized that in addition to the superior performance of the interactive window device, its construction is such as to be of modest cost relative to the benefits it provides. Also, since mechanical parts are virtually nonexistent, the need for maintenance is minimal.

Thus, it is apparent that there has been provided, in accordance with the invention, an interactive window display that fully satisfies the aims and advantages set forth above. While the invention has been described in conjunction with specific embodiments thereof, it is evident that many alternatives, modifications, and variations as to sizes, shapes, and materials will be apparent to those skilled in the art in light of the foregoing description. Accordingly, it is intended to embrace all such alternatives, modifications, and variations as fall within the spirit and broad scope of the appended claims.

I claim:

1. An interactive window display comprising:

a. sensor means for emitting a light beam and for producing an electrical signal in response to sensing the light beam;

b. reflector means fro selectively reflecting the light beam emitted by the sensor means back to the sensor means to be sensed thereby;

c. clear pane means interposed between the sensor means and the reflector means at a predetermined accurately controlled angle relative to the light beam for guiding the reflector means to accurately reflect the light beam back to the sensor means; and d. window display electrical device means disposed on the same side as the sensor means relative to the clear pane means for activating in response to the sensor means sensing the light beam, so that guiding the reflector means by the pane means in the path of the light beam remitted by the sensor means activates the window display electrical device means, and the light beam emitted by the sensor means and reflected by the reflector means back to the sensor means passes through the pane means.

2. The interactive window display of claim 1 wherein:

a. the sensor means is a single infrared sensor; and b. the electrical device means comprises a visual display that is activated solely by the sensing of the light beam by the infrared sensor.

3. The interactive window display of claim 1 wherein the reflector means comprises a small reflective card having a flat surface of highly reflective material carried in a person's hand to enable the person to intentionally activate the electrical device means by placing the reflective card flat surface in facing contact against the pane means and in the path of the light beam emitted by the sensor means to thereby properly guide the reflective card in the path of the light beam to reflect the light beam back to the sensor means.

4. The interactive window display of claim 3 wherein:

a. there are a plurality of electrical device means and a plurality of respective associated sensor means located on a first side of the pane means; and b. the reflective card is placed by the person in facing contact against a second side of the pane means and in the path of the light beam emitted by a selected sensor means to thereby activate the associated electrical device means.

5. Apparatus for controlling the activation of an electrical device including one of a window display and an appliance located at a first location by a person at a second location remote from the first location and separated therebetween by a pane of clear material, comprising:

a. a single infrared sensor located on the same side as the first location relative to the pane of clear material that emits a light beam along a first path;

b. circuit means for activating the electrical device solely in response to the infrared sensor sensing the light beam emitted therefrom; and c. a reflector held in the person's hand and placed in facing contact against the pane of clear material and guided thereby in the first path of the light beam to reflect the light beam along a second path back through the pane of clear material to the infrared sensor for being sensed thereby and thereby energizing the circuit means to activate the electrical device.

6. The apparatus of claim 5 wherein:

a. the pane of clear material is interposed in the first path, the pane defining a plane that lies at a predetermined orientation relative to the first path;

b. the infrared sensor, circuit means, and electrical device are located on a first side of the clear pane; and c. the reflector is placed by a person in facing contact against a second side of the clear pane to thereby reflect the light beam at a predetermined angle determined by the orientation of the pane from the second side of the pane back to the infrared sensor and thereby activate the electrical device on the first side of the pane.

7. The apparatus of claim 5 wherein:

a. the infrared sensor, the circuit means, and the electrical device are located inside a building room having a window made of clear material that separates the room from an adjacent space outside the room but that enables the person to see the electrical device from outside of the room, the window defining said plane that lies in a predetermined orientation relative to the first path;

b. the first and second paths of the light beam pass through the window; and c. the reflector is placed by the person in facing contact against the outside of the window to thereby reflect the light beam at a predetermined angle determined by the orientation of the window and activate the electrical device from outside of the room, so that the person can activate and see the electrical device inside the room from outside the room.

8. A method of activating an electrical device including one of a window display and an appliance comprising the steps of:

a. electrically connecting the electrical device to an infrared sensor;

b. emitting a light beam from the infrared sensor;

c. locating a pane of clear material in and at a selected and accurately controlled orientation relative to the path of the light beam so that the electrical device and the sensor are located at a first side relative to the pane of clear material;

d. placing a flat reflective surface by a person in facing contact against the pane of clear material at a second side relative thereof;

e. reflecting the light beam from the reflective surface at an accurate angle determined by the orientation of the clear pane back through the pane and back to the infrared sensor;

f. sensing the reflected light beam by the infrared sensor; and g. activating the electrical device in response to the sensing of the light beam by the infrared sensor.

9. The method of claim 8 comprising the further steps of:

a. placing the electrical device and the infrared sensor inside a room;

b. providing a window of a pane of clear material in a wall of the room that enables the person to view the electrical device from outside the room through the window;

c. passing the light beam emitted by the infrared sensor through the window;

d. placing the reflective surface by the person in facing contact against the window pane on the outside of the room; and e. reflecting the light beam back through the window to the infrared sensor, so that the person outside of the room can activate and view the electrical device inside the room.

10. The method of claim 9 wherein:

a. the step of electrically connecting the electrical device to ah infrared sensor comprises the steps of:

i. providing a plurality of infrared sensors inside the room; and ii. electrically connecting a plurality of electrical devices inside the room to corresponding infrared sensors;

b. the step of emitting a light beam from the infrared sensor comprises the step of emitting a light beam from each of the infrared sensors through the window;

c. the step of reflecting the light beam back to the infrared sensor comprises the step of reflecting the light beams from selected infrared sensors back through the window to those infrared sensors;

d. the step of sensing the reflected light beam by the infrared sensor comprises the step of sensing the light beams from the selected infrared sensors back to the those infrared sensors; and e. the step of activating the electrical device in response to sensing the light beam by the infrared sensor comprises the step of activating selected electrical devices in response to sensing the light beams reflected back to the corresponding infrared sensors.

* * * * *